US005238682A

United States Patent [19]

Akasaka et al.

[11] Patent Number: 5,238,682

[45] Date of Patent: Aug. 24, 1993

[54] INSECTPROOFING FIBERS AND METHOD FOR PREPARING THE SAME

[75] Inventors: Masanori Akasaka; Yoshirou Sawai; Kunio Iwase, all of Nagoya; Hideki Moriishi, Otake, all of Japan

[73] Assignee: Mitsubishi Rayon Co., Ltd., Tokyo, Japan

[21] Appl. No.: 797,059

[22] Filed: Nov. 25, 1991

[30] Foreign Application Priority Data

Nov. 30, 1990 [JP] Japan ..... 2-337151
Jan. 29, 1991 [JP] Japan ..... 3-026751

[51] Int. Cl.[5] ..... A01N 25/08

[52] U.S. Cl. ..... 424/409; 8/115.51; 8/DIG. 1; 424/405; 424/414; 424/419; 428/106; 428/156; 428/252; 428/266; 428/289; 428/422; 428/427; 428/428

[58] Field of Search ..... 424/405, 409, 414, 419; 8/115.51, DIG. 1; 428/266, 106, 156, 427, 252, 422, 428, 289

[56] References Cited

U.S. PATENT DOCUMENTS

| | | | |
|---|---|---|---|
| 4,103,450 | 8/1978 | Whitcomb | 43/131 |
| 4,352,833 | 10/1982 | Young. | 427/4 |
| 4,399,247 | 8/1983 | Ona et al. | 524/204 |
| 4,427,815 | 1/1984 | Ona et al. | 524/315 |
| 4,722,815 | 2/1988 | Shibanai | 424/419 X |
| 4,800,196 | 1/1989 | Nomura et al. | 514/159 |
| 4,931,524 | 6/1990 | Sato et al. | 527/301 |
| 4,973,620 | 11/1990 | Ona et al. | 524/292 |

FOREIGN PATENT DOCUMENTS

| | | |
|---|---|---|
| 0186146 | 7/1986 | European Pat. Off. . |
| 0251132 | 1/1988 | European Pat. Off. . |
| 3214610 | 11/1982 | Fed. Rep. of Germany . |
| 1-225644 | 9/1989 | Japan . |
| 2-264073 | 10/1990 | Japan . |

OTHER PUBLICATIONS

Database WPIL, AN-90-365608, JP-A-2 264 073, Oct. 26, 1990, "Preparation of . . . Insect . . . Proof Fibre-By Coating Fibre Surface With Mixture of Organic . . . Insecticide . . . Organo . . . Siloxane".

Database WPIL, AN-88-351233, & JP-A-63 264 506, Nov. 1, 1988, ". . . Insect . . . Proof Raw Material E. G. Bedding or Cushion Wadding-Is Surface Treated with Crosslinking Organo . . . Siloxane . . . Containing Functional Group for Low Toxicity and Improved Durability".

*Primary Examiner*—Thurman K. Page
*Assistant Examiner*—Robert H. Harrison
*Attorney, Agent, or Firm*—Oblon, Spivak, McClelland, Maier & Neustadt

[57] ABSTRACT

Insectproofing fibers are disclosed in which the surface of the fibers is coated with a mixture of an organic insectproofing agent, an organic insectproofing agent included in a monomer-trimer type cyclodextrin having an average molecular weight of 3000 or less and an organopolysiloxane, and the interior of the fibers is also impregnated with the mixture. The insectproofing fibers have an insectproofing effect against bugs for a long period of time and the effect is durable.

8 Claims, No Drawings

INSECTPROOFING FIBERS AND METHOD FOR PREPARING THE SAME

BACKGROUND OF THE INVENTION

1. Field of the Invention

The present invention relates to insectproofing fibers having a durable, excellent insectproofing performance against bugs, and it also relates to a method for preparing the insectproofing fibers.

2. Discussion of Background

Heretofore, it has been known that an insectproofing agent is applied onto fibers or fiber products to give an insectproofing performance to clothes and beddings. However, in the case that the application of the agent was achieved at a fiber processing step, the insectproofing agent is often fallen off the fibers during use, particularly during washing. Specifically speaking, the insectproofing performance is lost by washing the clothes or the like several times. Thus, the durability of the insectproofing performance was poor in the art.

In order to prevent this falling off, there have been proposed a means in which the morphology of fibers onto which the insectproofing agent is applied is made irregular in section, and another means for utilizing void-full fibers. Additionally, in the fields of commercial fiber articles, for example, in the fields of rugs such as carpets, there have also been proposed a method for introducing the insectproofing agent into a backing agent and another method for applying a quaternary ammonium base-containing organosiloxane onto polyester fibers for a quilt or the like.

Moreover, Japanese Patent Application Laid open Nos. 59-163426 and 60-57117 disclose that after stretching and washing steps in fiber manufacturing steps of acrylic fibers, an emulsion of an insectproofing agent such as an insect repellent or an organic phosphorus type insecticide is applied onto the fibers in a swelling state, followed by a dry heat treatment, whereby the insectproofing agent is contained or fixed in the fibers.

However, the insectproofing effect of the quaternary ammonium base-containing organosiloxane is extremely low, and therefore this agent is required to be used in a high concentration. On the other hand, the falling off of the insectproofing agent cannot be prevented sufficiently by the means in which the morphology of the fiber surface is modified, either. Thus, it was difficult to retain the insectproofing effect for a long period of time.

In the case that the insectproofing agent is mixed with a resin such as a binder and then applied to fibers, the fibers cannot smoothly pass through a spinning step and a knitting step, and a soft feeling of the fibers cannot be kept. In consequence, it is troublesome to use this method to the manufacture of clothes. Particularly, when imparting the insectproofing performance to the fibers in a fiber processing step, it is desirable, from the viewpoint of durability of the performance, to apply or deposit the insectproofing agent onto the surface of fibers. However, when a conventional resin is used as the binder, the insectproofing agent is damaged and fallen off the fibers in the subsequent steps by friction and the like, so that an insectproofing function deteriorates and processing devices tend to be contaminated and damaged with the dropped resin particles.

In addition, in the case of the fibers in which the insectproofing agent in the state of emulsion is only contained in the fibers, the insectproofing performance of the fibers can be maintained to certain extent under such relatively moderate conditions as in washing, but the falling off of the insectproofing agent cannot be prevented sufficiently under such conditions using hot water and steam as in a fiber processing step, particularly in a dyeing step in which various surface active agents as well as an acidic or alkaline treatment agent are also used, with the result that the maintenance of the insectproofing effect is difficult.

SUMMARY OF THE INVENTION

An object of the present invention is to provide insectproofing fibers having a durable insectproofing effect.

Another object of the present invention is to provide a method for economically preparing acrylic fibers having a durable insectproofing performance in a fiber manufacturing process.

A further object will be apparent to those skilled in the art from the following detailed description and appended claims.

An aspect of the present invention is directed to insectproofing fibers which fibers contain a mixture of an organic insectproofing agent, an organic insectproofing agent included in a monomer-trimer type cyclodextrin having an average molecular weight of 3000 or less and an organopolysiloxane. Thus, the surface of the fibers of the present invention is coated with the mixture and the interior of the fibers is impregnated with the mixture.

For purpose of the present invention, the term "contain a mixture in the fibers" includes the meaning that the fiber surface is coated or deposited with a mixture and that the interior of the fibers is impregnated with a mixture.

Furthermore, another aspect of the present invention is directed to a method for preparing acrylic fibers having insectproofing function which comprises the steps of extruding a solution of an acrylonitrile polymer dissolved in a solvent into a coagulating bath to form fibers, stretching and washing the fibers, applying a mixture of an organic insectproofing agent, an organic insectproofing agent included in a monomer-trimer type cyclodextrin having an average molecular weight of 3000 or less and a reactive organosiloxane onto the fibers in a primary swelling state having a swelling degree of from 50 to 500%, and then subjecting the fibers to an aftertreatment of the fibers such as drying, crimping and a heat relaxation treatment, successively.

DETAILED DESCRIPTION OF THE INVENTION

Organic insectproofing agents which can be used in the present invention mean insecticides, insectproofing agents, repellents and synergists effective for bugs such as fleas, lice and ticks. Examples of these organic insectproofing agents include organic phosphorus type insecticides such as fenitrothion, diazinon, acephate and prothiofos; carbamate type insecticides such as carbaryl and isoprocarb; pyrethroids series insecticides such as phenothrin, permethrin and cypermethrin; insectproofing agents such as camphor, naphthalene and paracyclobenzene; repellents such as propyl-N,N-diethyl succinamate, propyl mandelate, N,N-diethyl-m-toluamide, N-butylacetoanilide, 2-ethyl-1,3-hexanediol and 2-butyl-2-ethyl-1,3-propanediol, and synergists such as octachloro dipropyl ether, isobornyl thiocyanoacetate and piperonyl butoxide.

The reasons why the insectproofing agents in the present invention are limited to the organic compounds are (1) that the organic insectproofing agents vaporize even at an ambient temperature and get into the bodies of the bugs through respiratory organs thereof to heighten an insectproofing effect, (2) that stability of a reactive organosiloxane emulsion is more excellent than inorganic insectproofing agents and so the uniform insectproofing effect is obtained, and (3) that the organic insectproofing agents are very easily included in cyclodextrin, as compared with the inorganic insectproofing agents.

In the present invention, it is necessary to use a monomer-trimer type cyclodextrin having an average molecular weight of 3000 or less as an inclusion compound. The reason why the above cyclodextrin is used is that the cyclodextrin can effectively include the insectproofing agent and is excellent in compatibility with a reactive organosiloxane emulsion and can meet the requirement that a mixture of an organosiloxane, an organic insectproofing agent and an included organic insectproofing agent not only adheres to the surface of fibers but also penetrates the interior of the fibers. This mixture preferably penetrates the fibers in such a way that the amount of the mixture in the fibers gradually decreases from their surface toward their center. Since the mixture penetrates the interior of the fibers, the insectproofing agent is not fallen off the fibers in a dyeing and a finishing step and is not substantially dissolved in water and hot water in the washing. That is, the fibers of the present invention which contain a mixture of an insectproofing agent, an included insectproofing agent and an organopolysiloxane has washing resistance. The organopolysiloxane is formed from an organosiloxane as explained below.

The fact that the amount of the mixture in the fibers is on the decrease from the surface toward the center thereof can be confirmed in the following manner:

That is, the particle diameter of the cyclodextrin is from about 5 to about 18 angstroms. Pigment particles having a particle diameter corresponding to the diameter of the cyclodextrin particles are used in a confirmation test. The fibers are treated by the same procedure as the procedure used for preparing the insectproofing fibers. The confirmation can be achieved by observing the section of the fibers through an optical microscope.

The cyclodextrin has $\alpha$, $\beta$, $\gamma$ and $\delta$ homologues which have 6, 7, 8 and 9 glucoses, respectively, and have molecular weights of 972, 1135, 1297 and 1459, respectively. The monomer-trimer type cyclodextrin having an average molecular weight of 3000 or less can be prepared by polymerizing the cyclodextrin with the aid of a crosslinking agent such as epichlorohydrin. The including functions of the monomer-trimer type cyclodextrin are similar, and the respective homologues thereof can be used singly or in combination of two or more thereof. In the present invention, an unincluded organic insectproofing agent is used in addition to an organic insectproofing agent included in the monomer-trimer type cyclodextrin having an average molecular weight of 3000 or less. With regard to the included insectproofing agent, its insectproofing effect is scarcely decreased by washing and thus its durable effect is also excellent. In the present invention, in order to further improve the durability of the insectproofing agent, the fibers are impregnated with the included insectproofing agent, in addition to the application of the agent onto only the surface of the fibers. Therefore, it is not preferable that the cyclodextrin including the insectproofing agent is polymerized so as to have an average molecular weight of more than 3000. The cyclodextrin is preferably in a molecular state or a liquid state in order to penetrate the interior of the fibers. In the case that the cyclodextrin is the state of dispersion of a solid, the cyclodextrin is preferably as fine as possible. In the present invention, the size of the cyclodextrin is limited to the monomer-trimer type in view of its particle diameter.

The $\alpha$, $\beta$ and $\gamma$ homologues of the cyclodextrin have solubilities of 13%, 1.9% and 30%, respectively, in water at 25° C. and have solubilities of 109%, 25% and 198%, respectively, in water at 80° C. Hence, the solubility of the cyclodextrin depends upon the kind of selected homologue.

In general, the solubility of the cyclodextrin gradually decreases with the progress of its polymerization with the aid of a crosslinking agent such as epichlorohydrin, and a polymer having a molecular weight of 10,000 or more is not soluble at all in water any more. Therefore, the cyclodextrin required in the present invention is the monomer-trimer type having a molecular weight of 3000 or less. The monomer-trimer type cyclodextrin can be maintained so as to be in an emulsion or dispersion state suitable to penetrate the fibers by controlling a temperature, but when the cyclodextrin is a tetramer or a polymer having a molecular weight of about 4000 or more, the solubility of the cyclodextrin noticeably decreases, so that the desired effect cannot be obtained.

In the present invention, the organopolysiloxane functions to strongly stick both of the included and unincluded insectproofing agents on the fibers to prevent the falling off of the insectproofing agents and to thereby improve washing resistance and the retention of the insectproofing effect. In addition, the organopolysiloxane permits the fibers to smoothly pass through fiber processing steps, for example, a spinning step, a weaving step or a knitting step and provides the product with soft feeling and touch.

Another important role of the organopolysiloxane is to prevent the insectproofing agent penetrated in the fibers from falling therefrom in a dyeing step. That is, the reactive organosiloxane with which the fibers in a swelling state are impregnated together with the insectproofing agent forms a strong or tough organopolysiloxane film on the fibers by a subsequent heat treatment, so that the fibers containing the insectproofing agent therein are obtained. As a result, even if the structure of the fibers is loosened by a treatment at such a high temperature as the secondary transition temperature of acrylic polymer or higher in a fiber processing step, for example, a dyeing step such as a dip dyeing or a print dyeing, the above-mentioned tough organopolysiloxane film plays a very important role that the unincluded and included insectproofing agents in the fibers are prevented from falling off the fibers.

When any organopolysiloxane film is not present on the surface of the fibers, the insectproofing agent in the fibers is fallen off in large quantities in a dipping bath at the secondary transition temperature or higher or a steam treatment in the dyeing step of the fibers, and the dissolution or volatilization of the insectproofing agent is accelerated at the high temperature, with the result that the insectproofing effect decreases noticeably. In addition, when any organopolysiloxane film is not present on the surface of the fibers, the products made from the fibers rapidly lose the insectproofing effect during use and owing to washing.

As the reactive organosiloxane which is used to manufacture the organopolysiloxane, the compound represented by the following formula is used:

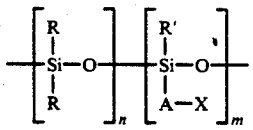

(wherein R is a lower alkyl group or an allyl group, R' is a hydrogen atom or a lower alkyl group, A is an alkylene group having 2 to 4 carbon atoms, each of n and m is an integer of 1 or more, and X is an epoxy group or a primary or a secondary amino group). The compound represented by this formula has the epoxy group or the amino group, and the film which is formed on the surface of the fibers by a self-crosslinking reaction is an organopolysiloxane having high smoothness and very strong affinity for the fibers.

In the present invention, since three components comprising the insectproofing agent included in the cyclodextrin, the unincluded insectproofing agent and the organopolysiloxane are contained in the fibers together, an extremely excellent insectproofing effect can be obtained. The included insectproofing agent retains the insectproofing effect for a long period of time owing to its slow volatilization function and is very excellent in durability to washing. On the other hand, the unincluded insectproofing agent is excellent in its effect at early stage.

The concentration of the insectproofing agent is preferably from 0.05 to 3% by weight, more preferably from 0.05 to 0.5% by weight based on the fibers. The amount of the cyclodextrin used for inclusion is the same as or more than the amount of the insectproofing agent in terms of mol % when the included insectproofing agent is prepared from the unincluded insectproofing agent in a separate step in advance. When the unincluded insectproofing agent and the included insectproofing agent are prepared at the same time, the molar amount of the cyclodextrin is preferably from 40 to 90% based on mols of the insectproofing agents.

When the concentration of the insectproofing agent is less than 0.05% by weight, the insectproofing effect is poor. However, when the concentration of the agent is more than 3% by weight, it is not preferable from the view point of safety and economy. In the case that the insectproofing agent included in the cyclodextrin is used, the retention period of the insectproofing effect is 1.5 times to several times as long as in the case that the insectproofing agent is used without inclusion, and the included insectproofing agent also functions to improve washing resistance. The solid concentration of the organopolysiloxane is preferably 0.1 to 3% by weight, more preferably 0.1 to 0.7% by weight base on the fibers. When the concentration of the organopolysiloxane is less than 0.1% by weight based on the fibers, it is impossible to keep up the durability of the insectproofing agent, and when it is more than 3% by weight based on the fibers, passage troubles of the fibers unpreferably tends to occur in a fiber processing step such as a spinning step. Besides, when the concentration of the organopolysiloxane is more than 3%, while the retention period of an insectproofing effect will be increased since the density of the film to be formed on the surface of the fibers is increased, the insectproofing effect will be decreased unless the concentration of the insectproofing agent is increased.

Examples of fibers which can be subjected to the insectproofing treatment according to the present invention include synthetic fibers such as acrylic fibers, polyamide fibers and polyester fibers as well as natural fibers such as wools and cottons. The characteristics of the insectproofing fibers of the present invention are noticeable when acrylic fibers are subjected to the insectproofing treatment in the form of a tow or a staples.

The insectproofing fibers of the present invention can be prepared not only by applying a mixture of an insectproofing agent, an included insectproofing agent and a reactive organosiloxane onto the fibers in a fiber manufacturing step but also by applying the mixture at a fiber processing step.

For example, the insectproofing fibers of the present invention can be prepared by dipping the staples of acrylic fibers in an aqueous solution (or emulsion) of a mixture of an insectproofing agent, an included insectproofing agent and an aminosiloxane by the use of a package type dyeing machine. At this time, the treating solution is forcedly circulated by means of a pump for 30 minutes or more at a temperature of 90° C. which is higher than the secondary transition temperature of an acrylic fiber, the solution is then removed from the fibers by a centrifugal separator, and the fibers are dried, followed by a crosslinking treatment of the aminosiloxane at a temperature of about 100° C. to form a polyaminosiloxane. The fibers thus treated can be passed through a spinning step, a weaving step and a finishing step for a carpet, a blanket or the like of acrylic fibers without any problem. The product thus obtained has the same soft touch and feeling as the untreated fiber product and has the insectproofing effect resistant to washing, particularly a tick-controlling effect for a long period of 2 years or more.

A method for sticking the insectproofing agent on the fibers according to the present invention is an extremely rational which method comprises the steps of extruding a solution of an acrylonitrile polymer dissolved in a solvent into a coagulating bath to form fibers, stretching and washing the fibers, applying the insectproofing agent onto the fibers while the fibers are in a primary swelling state, followed by drying, crimping and a heat relaxation treatment. In the process for applying the insectproofing agent onto the fibers, an important point is that the acrylic fibers are in the primary swelling state, and when the fibers are in this state, a mixture of an included insectproofing agent, an unincluded insectproofing agents and an organosiloxane are applied onto the surface and thus the mixture can penetrate the interior of the fibers. In the present invention, the primary swelling state of the fibers is represented by a swelling degree. The fiber structure at the primary swelling state mentioned above is very loose so that the swelling degree of that fibers is from 50 to 500%, while that of an ordinary acrylic fibers is from 15 to 30%.

The primary swelling state of the acrylic fibers means a state of the fibers after the steps of extrusion of the polymer solution, and stretching and washing of the fibers, but before the step of drying fibers. Although the swelling degree depends upon fiber manufacturing conditions, it varies with the manufacturing steps. That is, the less the step number is, the larger the value of the swelling degree is, and the lower a fiber formation degree is. In the present invention, the primary swelling degree of the fibers at the time when the insectproofing agent is applied is from 50 to 500%, but it is preferable that the swelling degree is from 150 to 300% at which the fiber formation is sufficiently completed and at a step after the stretching and washing.

No particular restriction is put on the polymer of acrylic fibers which is used in the present invention, and it may be a homopolymer of acrylonitrile or a copolymer of acrylonitrile and another vinyl monomer. An example of the acrylonitrile copolymer is a copolymer which can be obtained by copolymerizing at least 40% by weight of acrylonitrile and 60% by weight or less of acrylic acid, methacrylic acid or its alkyl ester, or a vinyl monomer such as vinyl chloride, vinyl acetate, vinylidene chloride, sodium allylsulfonate, sodium methallylsulfonate, sodium vinylsulfonate or sodium styrenesulfonate. In forming the fibers from the acrylonitrile polymer, inorganic substances such as titanium oxide pigments and organic substances may be blended with a solution of an acrylonitrile polymer for the purpose of giving functions such as matting, coloring, conductivity and bacteria resistance to the fibers. A solution for spinning can be prepared by dissolving an acrylonitrile polymer in an organic solvent such as dimethylformamide, dimethylacetamide or dimethyl sulfoxide, or an inorganic solvent such as an aqueous solution of nitric acid, a rhodanate or zinc chloride, but no particular restriction is put on the solvent, so long as it provides good solubility and spinning properties in a fiber forming step.

The spinning solution is extruded into the coagulating bath mainly comprising a mixed solution of water and the organic or inorganic solvent for the acrylonitrile polymer, and after the stretching and washing steps, the fibers are passed through a bath containing a mixture of an organic insectproofing agent, a cyclodextrin-included insectproofing agent and a reactive organosiloxane to apply the mixture to the fibers. The bath may be a single bath containing all of the components of the mixture or may be comprised of two or more bathes each containing one or two components of the mixture. The fibers which have been provided with the mixture of the included and unincluded insectproofing agents and the reactive organosiloxane are then subjected to drying, crimping and a heat relaxation treatment successively to prepare a tow or cut fibers.

The fibers treated in accordance with the present invention can be passed through a spinning step, weaving step and finishing step without any problem, as in the case of conventional acrylic fibers, and the product from the fibers has a soft touch and feeling as in the untreated fiber product, and additionally has a washing resistant insectproofing effect, particularly a tickcontrolling effect for a long period of 2 to 3 years or more.

EXAMPLES

Now, the present invention will be described in further detail with reference to Examples. However, it should be understood that the present invention is by no means restricted by such specific Examples. In the Examples, the insectproofing effect can be evaluated as follows: 300 acaridiae and 150 mg of a culture medium are placed in a 5-ml screw tube containing 0.2 g of fibers to be evaluated, and the acaridiae are then grown at 25° C. at RH of 75%. After 48 hours, the alive ticks are counted, and a lethal ratio is then calculated. The evaluation is made from this lethal ratio. The lethal ratio can be calculated in accordance with the following equation.

$$\text{Letahl Ratio (\%)} = [(A-B)/A] \times 100$$

A: total number of used ticks, and

B: total number of alive ticks after 48 hours.

The swelling degree can be calculated from the following equation by the use of fibers in a swelling state.

$$\text{Swelling Degree (\%)} = [(W_1 - W_2)/W_2] \times 100$$

$W_1$: The weight of fibers after about 1 g of the fibers were dipped in 100 cc of water at 20° C. for 1 hour or more and then dehydrated under a centrifugal force of 100 G for 10 minutes by means of a centrifugal separator.

$W_2$: The weight of the fibers after the dehydrated fibers were absolutely dried at 110° C.

EXAMPLES 1 to 3 AND COMPARATIVE EXAMPLE 1 and 2

In each example, 10 kg of cut fibers, Vonnel V17B (trade name, made by Mitsubishi Rayon Co., Ltd., acrylic fiber) of 3 d ×102 mm were treated under conditions as shown in Table 1.

An isobornyl thiocyanoacetate (molecular weight about 253, hereinafter referred to as "IBTA") as an insectproofing agent was treated with different cyclodextrins to prepare included insectproofing agents. The molar amount of the cyclodextrins used were less than that of IBTA. A nonionic dispersant (addition product of ethylene oxide with ethyl hexanol), an aqueous emulsion of aminosiloxane (emulsion with the nonionic dispersant, solid content 40%) and water were added to the included IBTA to prepare treating solutions containing 0.14 g/1 of IBTA, 0.34 g/1 (in Examples 1 and 2, and Comparative Example 1) or 0.39 g/1 (in Comparative Example 2) of the cyclodextrin, 0.14 g/1 of the dispersant, and 0.5 g/1 of the aminosiloxane.

Applications of the solutions to the fibers to prepare insectproofing fibers were carried out at 90° C. for 45 minutes by means of a package dyeing machine at a bath ratio of 1:10, while the solutions were passed through the machine in a manner of in to out by a circulating pump, respectively. Afterward, the fibers were dehydrated at a squeeze ratio of 30% by means of a centrifugal hydroextractor, and the fibers were then subjected to a film forming treatment with dry heat at 100° C. for 10 minutes. The amount of IBTA and the cyclodextrin on the fibers thus obtained are set forth in Table 1.

Mixtures of 50% of the fibers thus treated and 50% of the same kind of untreated fibers were spun in the worsted spinning to obtain spun yarns of 1/20 MC ×290 T/M.Z, respectively. The spun yarns had no problem and were comparable to spun yarns of untreated fibers alone in respect of properties of passing through fiber processing steps and yarn qualities.

The spun yarns and polyester filaments of 150 d/48 f were used as a warp and a weft, respectively, to make plain weave sheets of about 300 g/m$^2$, and the sheets were then dyed light blue under conditions as shown in Table 2 by means of an atmospheric pressure type liquid stream dyeing machine, washed with water, softened and then dried at 100° C. for 3 minutes by the use of a pin tenter to prepare insectproofing sheets, respectively.

In this case, any troubles did not occur in the fiber processing steps, and the obtained product had the same feeling and touch as in a product made from untreated fibers.

About 30 cm ×30 cm small specimens were made from the sheets and then washed 10 times or 20 times in accordance with JIS 103, and tick resistance was evaluated before and after washing. The results are set forth in Table 3. It was confirmed from these results that the insectproofing fibers of the present invention had excellent washing resistance.

TABLE 1

| Example No. | Cyclodextrin Compound | Molecular weight | Amount of cyclodext rin (% owf) | Amount of IBTA (% owf) |
|---|---|---|---|---|
| Example 1 | β-cyclodextrin | 1135 | 0.34 | 0.14 (0.07) |
| Example 2 | β-cyclodextrin | 2800 | 0.34 | 0.14 (0.07) |
| Comp. Ex. 1 | β-cyclodextrin | 6800 | 0.34 | 0.14 (0.07) |
| Example 3 | γ-cyclodextrin | 1297 | 0.39 | 0.14 (0.07) |
| Comp. Ex. 2 | — | — | — | 0.14 |
| Control | — | — | — | — |

Each value in the parentheses was the amount of the unincluded insectproofing agent (IBTA).

TABLE 2

| | | |
|---|---|---|
| Dyeing conditions | Catiron Blue KGLH (made by Hodogaya Chemical Co., Ltd.; cationic dye) | 0.1% owf |
| | Catiogen PAN (made by Daiichi Kogyo Co., Ltd.; cationic surface active agent) | 1.0% owf |
| | Acetic Acid | 1.0% owf |
| | LR 1:25; boiling × 60 min. | |
| Soft Finishing Conditions | Tafuron Sicol (made by Daiichi Kogyo Co., Ltd.; cationic softener) | 0.5% owf |
| | LR 1:25; 40° C. × 10 min. | |

TABLE 3

| Example No. | After processing (before washing) | After washing 10 times | After washing 20 times |
|---|---|---|---|
| Example 1 | 90< | 80 | 70 |
| Example 2 | 90< | 80 | 70 |
| Comp. Ex. 1 | 90< | 80 | 30 |
| Example 3 | 90< | 80 | 70 |
| Comp. Ex. 2 | 50 | 10> | 10> |
| Control | 10> | 10> | 10> |

Insectproofing effect: lethal ratio (%)

EXAMPLES 4 AND 5, COMPARATIVE EXAMPLES 3 AND 4

A package dyeing machine was packed with 10 kg of Luna Ace (made by Mitsubishi Rayon Co., Ltd., polyester staple) of SD 6 d ×64 mm as in Example 1, and insectproofing treatments were carried out under the conditions as shown in Table 4. The staples thus treated were mixed with similar untreated fibers to form mixed yarns containing 30% of the treated staples, and the mixed yarns were then subjected to a carding treatment to prepare fibers for a quilts, and coverlets were further made therefrom, respectively.

TABLE 4

| Example No. | Comp. Example 3 | Example 4 | Example 5 | Comp. Example 4 |
|---|---|---|---|---|
| Insectproofing agent | Deet* | Deet | Deet | Lead arsenate |
| Application concentration (% owf) (Concentration of unincluded agent) | 0.25 (0.1) | 0.25 (0.1) | 0.25 (0.1) | 0.25 (0.1) |
| β-cyclodextrin (% owf) (molecular weight 1135) | 0.9 | 0.9 | 0.9 | 0.9 |
| Tetrosin KE* (g/l) | — | 2 | — | — |
| Epoxysiloxane (% owf) | 0.3 | 0.3 | 0.3 | 0.3 |
| Treatment temp. (°C.) | 100 | 100 | 130 | 130 |
| Time (min) | 60 | 60 | 60 | 60 |
| Bath ratio | 1:10 | 1:10 | 1:10 | 1:10 |

*Tetrosin KE: made by Yamakawa Yakuhin Co., Ltd., carrier for polyester fiber, Methylnaphthalene type
Deet: N,N-diethyl-m-toluamide The properties of passing through the fiber processing steps of the insectproofing fibers were inspected in a processing step, particularly in a carding step. In the insectproofing fibers in Comparative Example 4, the emulsion dispersibility of the epoxysiloxane was deteriorated owing to lead arsenate, the mixture was applied onto the fibers in an ununiformed state and many neps came out. With regard to the insectproofing fibers in Comparative Example 3 as well as Examples 4 and 5, the good carding could be achieved. The insectproofing performance of the fibers thus obtained for quilts were inspected before washing (after the processing), after the domestic washing and after dry cleaning. The results are set forth in Table 5. It was confirmed from these results that the insectproofing fibers of the present invention were excellent in insectproofing performance and its washing resistance.

TABLE 5

| Example No. | Comp. Ex. 3 | Example 4 | Example 5 | Comp. Ex. 4 |
|---|---|---|---|---|
| After processing | 90< | 90< | 90< | 80 |
| Wash resistance | | | | |
| Domestic washing (JIS 105, 5 times) | 30 | 80 | 70 | 20 |
| Dry cleaning (petroleum solvent) | 10> | 70 | 60 | 20 |

EXAMPLE 6 AND COMPARATIVE EXAMPLE 5

A spun yarn (32/1 cc) of 100% cotton was rewound onto a cheese dyeing tube, and then scoured under different conditions as shown in Table 6 by means of a 1 kg type cheese dyeing machine, followed by an insectproofing treatment under the conditions as shown in Table 6.

TABLE 6

| Example No. | Example 6 | Comp. Ex. 5 |
|---|---|---|
| Scouring | | |
| $H_2O_2$ (g/l) | 5 | 5 |
| NaOH (g/l) | 2 | 2 |
| POE type nonionic surfactant (g/l) | 1 | 1 |
| 100° C. × 30 min LR 1:20 | | |
| ↓ | | |
| (neutralization) | | |
| Acetic acid 1 g/l 70° C. × 20 min | | |
| Insectproofing treatment | | |
| Acefate (organic phosphorous type | 0.5 | 0.5 |

TABLE 6-continued

| Example No. | Example 6 | Comp. Ex. 5 |
|---|---|---|
| insecticide; MW about 183) (% owf) | (0.22) | (0.22) |
| α-cyclodextrin (% owf) | 1.5 | 1.5 |
| Ethylhexyl glycohol (emulsifier) (% owf) | 1 | 1 |
| $Na_2SO_4$ (swelling agent for cotton) (% owf) | 20 | — |
| 100° C. × 45 min LR 1:20 | | |
| ↓ | | |
| (run out the solution) | | |
| ↓ | | |
| Aminosiloxane (% owf) | 0.3 | 0.3 |
| 40° C. × 20 min LR 1:20 | | |
| ↓ | | |
| Drying (cheese drier) 90° C. × 60 min | | |

Each value in the parentheses was the amount of the unincluded agent.

The cotton yarns which had been subjected to the insectproofing treatment were used to prepare moquette fabrics for an upholsteries, and the fabrics were continuously dyed according to a pad-steam method and then passed through a brushing finish step without any problem. The feeling and touch of the upholsteries were the same as those of a conventional article. The insectproofing performance after a dry cleaning treatment was evaluated and the insectproofing performance during practical usage was also evaluated by the use of specimens which had been treated at 45° C. for 1000 hours in a hot air drier. The results are set forth in Table 7. It was confirmed from these results that the insectproofing fibers of the present invention were excellent in durability of the insectproofing effect.

TABLE 7

| Example No. | Example 6 | Comp. Ex. 5 |
|---|---|---|
| After processing | 100 | 100 |
| After dry cleaning | 80 | 50 |
| After heat treatment (45° C. × 1000 hr) | 90 | 40 |

Insectproofing effect: lethal ratio (%)

EXAMPLE 7 AND COMPARATIVE EXAMPLE 6 to 9

An acrylonitrile copolymer made of 93.1% by weight of acrylonitrile unit and 6.9% by weight of methyl acrylate unit was dissolved in dimethylacetamide to form a spinning solution containing 20.0% by weight of the acrylonitrile copolymer. This spinning solution was extruded into a coagulating bath of an aqueous solution containing 43% by weight of dimethylacetamide at a temperature of 35° C. through a nozzle having 4,000 orifices diameter of which orifice was 0.06 mm to form fibers, and after washing with water, the fibers were stretched 5 times. Afterward, the resulting fibers were treated with a solution (D) obtained by dispersing IBTA with a nonionic surface active agent, a solution (C) obtained by including IBTA in β-cyclodextrin having a molecular weight of 2800 in such a ratio as 100 mols of IBTA/70 mols of cyclodextrin and then dispersing the included IBTA with a nonionic surface active agent, a solution (A) or a solution (B) which were prepared by adding aminosiloxane to solution (C) or solution (D), respectively, to such an extent that the amount of IBTA was 0.1% owf. Further, the fibers treated with the solution (A) or (B) were additionally treated in a second bath to such an extent that the amount of aminosiloxane was 0.5% owf. All of the fibers were then dried by a roller dryer at 140° C., mechanically crimped, subjected to a wet heat relaxation treatment at 140° C., and then cut to obtain bright cut fibers Nos 1 to 4 of 2 d ×51 mm.

For comparison, the solution (A) was applied to the fibers which had not been subjected to the insectproofing treatment in the fiber manufacturing step by a package dyeing machine to such an extent that the amount of IBTA was 0.1% owf and that the amount of aminosiloxane was 0.5% owf, and the fibers were dried at 150° C. for 10 minutes and then subjected to a treatment to form a film of polyaminosiloxane on the surface of the fibers to obtain cut fibers No. 5. A mixture of 50% of each of these fibers Nos. 1 to 5 and 50% of ordinary acrylic bright fibers of 2 d ×51 mm which had not been subjected to the insectproofing treatment were spun to yarns of 2/48 meter cotton count by worsted spinning, and knitted clothes were then prepared therefrom, respectively. Each knitted cloth was dyed and softened under the conditions mentioned below, and then washed in accordance with JIS 103. Afterward, an insectproofing effect of undyed or dyed clothes was evaluated before and after the washing. The results are set forth in Table 8.

| | |
|---|---|
| Dyeing conditions: | |
| Catiron Red KGLH (made by Hodogaya Chemical Co., Ltd.; cationic dye) | 0.1% owf |
| Catiogen PAN (made by Daiichi Kogyo Co., Ltd.; cationic surface active agent) | 1.0% owf |
| Acetic acid | 1.0% owf |
| pH = 4.5, LR = 1.25, 100° C. × 30 min. | |
| Softening conditions: | |
| Tafuronshul (made by Daiichi Kogyo Co., Ltd.; cationic softening agent) | 1.0 owf |
| LR = 1.25, 40° C. × 10 min. | |

TABLE 8

| Example No. | Cut fiber No. | Insectproofing treatment condition: solution used in fiber manufacturing step | Insectproofing treatment condition: solution used in fiber processing step | Insectproofing effect (%) before dyeing number of washing: 0 | 10 | 20 | after dyeing number of washing: 0 | 10 | 20 |
|---|---|---|---|---|---|---|---|---|---|
| Example 7 | 1 | Solution A | — | 100 | 90 | 80 | 80 | 70 | 60 |
| Comp. Ex. 6 | 2 | Solution B | — | 90 | 80 | 70 | 50 | 40 | 30 |
| Comp. Ex. 7 | 3 | Solution C | — | 80 | 70 | 60 | 30 | 20 | 20 |
| Comp. Ex. 8 | 4 | Solution D | — | 80 | 70 | 60 | 30 | 20 | 10 |
| Comp. Ex. 9 | 5 | — | Solution A | 100 | 70 | 60 | 70 | 60 | 50 |

*Solution A: Solution C + emulsified aminosiloxane → aminosiloxane
Solution B: Solution D + emulsified aminosiloxane → aminosiloxane
Solution C: IBTA + β-cyclodextrin + nonionic dispersant
Solution D: IBTA + nonionic dispersant In Comparative Examples 7 and 8, the washing resistance of the insectproofing effect of the undyed clothes remained at a good level, but when dyed, the insectproofing agent was vaporized and fell off the clothes noticeably, and the clothes obtained did not have a performance necessary for practical usage. Furthermore, in Comparative Examples 6 and 9, even after the dyeing, the clothes had a good quality. However, in respect of the washing resistance, the clothes of the present invention were most excellent.

EXAMPLE 8 AND COMPARATIVE EXAMPLE 10

An acrylonitrile copolymer containing 59.0% by weight of acrylonitrile unit, 40.0% by weight of vinylidene chloride unit and 1.0% by weight of sodium methallylsulfonate unit was dissolved in dimethylformamide to form a spinning solution containing 25.0% by weight of the acrylonitrile copolymer. This spinning solution was then extruded into a coagulation bath of an aqueous solution containing 55.0% by weight of dimethylformamide at a temperature of 35° C. through a nozzle having 2,000 orifices diameter of which orifice was 0.10 mm to form fibers, and after washing with water, the fibers were stretched 5.5 times. On the other hand, a solution (F) was prepared by dispersing N,N-diethyl-m-toluamide (hereinafter referred to simply as "Deet") with a nonionic surface active agent and a solution (E) was also prepared by including Deet in β-cyclodextrin having a molecular weight of 1135 in such a ratio as 100 mols of Deet/80 mols of cyclodextrin and then dispersing the included Deet with a nonionic surface active agent. The solution (E) or (F) was applied onto the fibers to such an extent that the amount of Deet was 0.15% owf. The fibers were then dried by a roller dryer at 130° C. to make the fiber structure compact, and an emulsion type aminosiloxane was further applied onto the fibers in a second bath to such an extent that the amount of aminosiloxane was 0.3% owf. Next, the fibers were dried by a hot air dryer at 120° C., subjected to a wet heat relaxation treatment at 110° C., and then cut to obtain bright cut fibers Nos. 6 and 7 of 10 d ×102 mm. The cut fibers thus obtained were dyed wine color under such conditions as shown below, and an insectproofing performance was evaluated before and after the dyeing. Furthermore, mixtures of 50% of the fibers prepared by Example 8 or Comparable Example 10 with 50% of ordinary acrylic dull fibers of 8 d ×102 mm which had been dyed the same color but which had not been subjected to the insectproofing treatment were spun to form mixed yarns of cotton count 1/5 MC by semiworsted spinning, respectively. Afterward, mats were made from the spun yarns. Some of the mats were washed 10 times or 20 times in accordance with JIS 103, and the other mats were allowed to stand in a hot air drier at 50° C. for 100 hours for an acceleration test of change with time of use. Next, an insectproofing performance was evaluated. The results are set forth in Table 9.

| | |
|---|---|
| Dyeing conditions: | |
| Catiron Yellow 3GLH (made by Hodogaya Chemical Co., Ltd.; cationic dye) | 0.01% owf |
| Catiron Red 3GLH (made by Hodogaya Chemical Co., Ltd.; cationic dye) | 0.8% owf |
| Catiron Blue GLH (made by Hodogaya Chemical Co., Ltd.; cationic dye) | 0.008% owf |
| Catiogen AN Super (made by Daiichi Kogyo Co., Ltd.; cationic surface acive agent) | 1.0% owf |
| pH = 4.5, LR = 1.10, 100° C. × 40 min. | |
| Finish Treatment Conditions: | |
| Tafuronspin 78ND (made by Daiichi Kogyo Co., Ltd.; cationic softener) | 1.0% owf |

-continued

| | |
|---|---|
| LR 1:25; 40° C. × 10 min. | |

TABLE 9

| Example No. | Solution* | Insectproofing effect (%) Cut fiber before dyeing | Cut fiber after dyeing | Dyed mat before washing | Dyed mat after 10 times washing | Dyed mat after hot air drying |
|---|---|---|---|---|---|---|
| Example 8 | Solution E | 100 | 90 | 70 | 50 | 60 |
| Comp. Ex. 10 | Solution F | 100 | 50 | 30 | 20 | 20 |

*Solution E: Deet + β-cyclodextrin + nonionic activator → aminosiloxane
Solution F: Deet + nonionic activator In Comparative Example 10, the insectproofing performance of the fibers to which Deet was applied with the nonionic dispersant was deteriorated noticeably after dyeing, and the insectproofing effect of a mat made from the 50% mixed yarn was poor and did not have performance necessary for practical use.

On the contrary, the cut fibers in Example 8 were excellent in the dyeing resistance and the washing resistance, and the change of the insectproofing effect onto the mats with time of usage was satisfactorily small.

EXAMPLES 9 TO 11, COMPARATIVE EXAMPLES 11

An acrylonitrile copolymer containing 94.2% by weight of acrylonitrile unit, 5.3% by weight of vinyl acetate unit and 0.5% by weight of sodium methallylsulfonate unit was dissolved in dimethylacetamide to form a spinning solution containing 18.0% by weight of the acrylonitrile copolymer. This spinning solution was extruded into a coagulating bath of an aqueous solution containing 30.0% by weight of dimethylacetamide at a temperature of 40° C. through a nozzle having 4,000 orifices diameter of which orifice was 0.06 mm to form fibers, and after washing with water, the fibers were stretched 4 times. On the other hand, solutions G, H, I and J were prepared as follows:

Deet was included in each cyclodextrin as shown in Table 10 in such a ratio as 100 mols of Deet/50 mols of cyclodextrin and then dispersed with a nonionic surface active agent, and an emulsion type aminosiloxane was added thereto. These solutions G, H, I and J were applied onto the fibers having a swelling degree of 320% in a primary swelling state to such an extent that the amount of Deet was 0.1% owf and that the amount of aminosiloxane was 0.6% owf. The fibers were then dried by a roller dryer at 140° C., mechanically crimped, subjected to a wet heat relaxation treatment at 135° C., and then cut to obtain 4 kinds of bright cut fibers of 3 d ×102 mm. Each of these cut fibers were mixed with ordinary bright acrylic fibers of 3 d ×102 mm which had not been subjected to the insectproofing treatment and spun to form mixed yarns containing 40% of the insectproofing fibers, respectively. The mixed yarns were then twined into 32 meter cotton count of warps. Next, these warps were woven with a weft of polyester semidull filaments of 150 d/48f to make plain weave sheets of about 300 g/m$^2$. These sheets were then dyed under the same conditions as in Example 7, and then washed 10 times or 20 times in accordance with JIS 103 and subjected to dry cleaning with a petroleum solvent. Afterward, insectproofing performance was evaluated, and the results are set forth in Table 10.

The high-molecular weight β-cyclodextrin in Comparative Example 11 was present in the form of large grains, and the application to the fiber was poorer than in Examples 9 to 11 and the insectproofing effect was slightly low, even before the washing of the undyed fibers. The falling of the insectproofing agent off the fibers of Comparable Example 11 was slightly noticeable at the times of the dyeing and washing, and the durability of the insectproofing effect deteriorated. However, in Examples 9 to 11, the decrease of the insectproofing effect was very small after dyeing and after washing, and the practically excellent insectproofing sheets were obtained.

TABLE 10

| | Insectproofing treatment condition | | | Insectproofing effect (%) | | | | | |
|---|---|---|---|---|---|---|---|---|---|
| | | | | before dyeing | | after dyeing | | | |
| | | cyclodextrine | | number of washing | | number of washing | | | number of dry cleaning |
| | Solution | type | molecular weight | 0 | 2 | 0 | 10 | 20 | 3 |
| Example 9 | Solution G | β | 1135 | 100 | 90 | 80 | 80 | 70 | 70 |
| Example 10 | Solution H | β | 2800 | 100 | 90 | 80 | 70 | 60 | 60 |
| Example 11 | Solution I | γ | 1297 | 100 | 90 | 80 | 80 | 60 | 60 |
| Comp. Ex. 11 | Solution J | β | 6800 | 70 | 60 | 50 | 30 | 20 | 30 |

When an organic insectproofing agent is only applied onto fibers or fiber products, the retention period of an insectproofing effect is usually from 1 to 3 months. On the contrary, in the fibers of the present invention, a mixture of an insectproofing agent included in a specific cyclodextrin, an unincluded free insectproofing agent and an organosiloxane is applied to the fibers and thus the mixture forms a film on the surface of the fibers and further penetrates the interior of the fibers. Accordingly, the retention period of the whole insectproofing effect is as long as 2 to 3 years owing to both the free insectproofing agent for exerting the insectproofing effect at an early stage and the included insectproofing agent for slowly exerting the insectproofing effect. Additionally, in the fibers of the present invention, the falling off of the insectproofing agent by washing scarcely occurs, and the fiber products made therefrom are excellent in feeling, touch, softness and smoothness. Moreover, the passage of the fibers in fiber processing steps can be achieved without any problem.

What is claimed is:

1. Insectproofing fibers, comprising:

(A) fibers selected from the group consisting of acrylic fibers, polyamide fibers, polyester fibers, wool and cotton;

(B) from 0.05 to 3% by weight of an organic insectproofing agent selected from the group consisting of insecticides, repellents and synergists, based on the weight of the fibers;

(C) a cyclodextrin having an average molecular weight of from 972 to 3000 and an included organic insectproofing agent selected from the group consisting of insecticides, repellents and synergists, said cyclodextrin being present in from 40 to 90 mol % based on the total molar amount of said organic insectproofing agent and said included organic insectproofing agent; and (D) from 0.1 to 3% by weight of an organopolysiloxane prepared from a reactive organosiloxane represented by the formula:

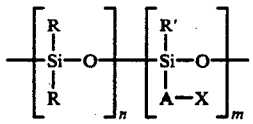

based on the weight of the fibers.

2. The insectproofing fibers of claim 1, wherein said organic insectproofing agent is selected from the group consisting of fenitrothion, diazinon, acephate, prothiofos, carbaryl, isoprocarb, phenothrin, permethrin, cypermethrin, camphor, naphthalene, para-cyclobenzene, propyl-N,N-diethyl succinamate, propyl mandelate, N,N-diethyl-m-toluamide, N-butylacetoanilide, 2-ethyl-1,3-hexanediol, 2-butyl-2-ethyl-1,3-propanediol, octachloro dipropyl ether, isobornyl thiocyanoacetate and piperonyl butoxide.

3. The insectproofing fibers according to claim 1 wherein the cyclodextrin is β-cyclodextrin.

4. The insectproofing fibers according to claim 1 wherein the organic insectproofing agent is selected from the group consisting of isobornyl thiocyanoacetate and N,N-diethyl-m-toluamide.

5. The insectproofing fibers according to claim 1 wherein the fibers are acrylic fibers.

6. The insectproofing fibers according to claim 1 wherein the fibers are polyester fibers.

7. The insectproofing fibers of claim 1, wherein said included organic insectproofing agent is selected from the group consisting of fenitrothion, diazinon, acephate, prothiofos, carbaryl, isoprocarb, phenothrin, permethrin, cypermethrin, camphor, naphthalene, para-cyclobenzene, propyl-N,N-diethyl succinamate, propyl mandelate, N,N-diethyl-m-toluamide, N-butylacetoanilide, 2-ethyl-1,3-hexanediol, 2-butyl-2-ethyl-1,3-propanediol, octachloro dipropyl ether, isobornyl thiocyanoacetate and piperonyl butoxide.

8. The insectproofing fibers of claim 1, wherein said included organic insectproofing agent is selected from the group consisting of isobornyl thiocyanoacetate and N,N-diethyl-m-toluamide.

* * * * *